United States Patent [19]

Peterson

[11] 4,034,972

[45] July 12, 1977

[54] EXAMINATION TABLE

[75] Inventor: Warren J. Peterson, Stevens Point, Wis.

[73] Assignee: Joerns Furniture Company, Stevens Point, Wis.

[21] Appl. No.: 609,172

[22] Filed: Sept. 2, 1975

[51] Int. Cl.[2] ..... A61G 13/00

[52] U.S. Cl. ..... 269/324

[58] Field of Search ..... 269/322–326; 5/60, 62, 66, 67, 68, 92, 317 R; 250/439, 445, 446, 447

[56] References Cited

U.S. PATENT DOCUMENTS

| | | | |
|---|---|---|---|
| 2,267,973 | 12/1941 | Demcak | 269/324 |
| 3,810,263 | 5/1974 | Taylor et al. | 269/323 |

*Primary Examiner*—Harold D. Whitehead

*Assistant Examiner*—Robert C. Watson

*Attorney, Agent, or Firm*—Price, Heneveld, Huizenga & Cooper

[57] ABSTRACT

The specification discloses an articulated patient support cushion for a medical examining table including an over-center type, gavity-operated support means for securely holding a pivotable section of the one-piece, seamless cushion at an upward angle to avoid accidental release. Also disclosed is a one-piece paper tray having a depressed trough for holding and dispensing paper from a roll to cover the cushion. The tray is pivotable downwardly after release of a latch means for insertion of a roll of paper in the trough. An extendible and retractable carriage assembly at the foot end of the examining table is also disclosed including means for supporting a leg rest pad and/or a drainage pan thereon.

8 Claims, 12 Drawing Figures

EXAMINATION TABLE

BACKGROUND OF THE INVENTION

This invention relates to tables for supporting a patient during a medical examination and, more particularly, to an articulated patient support cushion including means for supporting a portion of that cushion at an elevated angle, a paper tray for dispensing paper for covering such a cushion, and extendible means for supporting a leg rest pad and/or drainage pan at one end of the table.

Prior known medical examination tables have typically included articulated top sections for supporting a patient in various positions during an examination. Such top sections include a pivotable portion which is elevated or pivoted upwardly and supported in the elevated position. Prior known structures for supporting such pivotable sections in the elevated position have often been undesirable and unreliable. For example, one method for supporting such sections has been to provide pivotal legs on the undersurface of the articulated section. The legs are pivoted to a downwardly extending position when support of the section in the raised position is desired. Without elaborate bracing or other supporting structure, however, such legs have often tended to slip back to their folded positions when weight or force is applied to the articulated section. Such accidental release can be extremely dangerous especially when a doctor is performing a delicate treatment on the supported patient.

It is also well known to provide a paper covering from a roll of paper over the articulated top section or patient support cushion for successive patients for sanitary reasons. Prior known structures for dispensing paper from such rolls have typically included axles or other structures suspended beneath the top section or patient support cushion and extending through or into the roll to rotatably mount the roll. Often, such structure has been unpleasing from the aesthetic standpoint and has been concealed within the table structure. On the other hand, when the apparatus is so concealed, it is often difficult and time consuming to insert and remove paper rolls from their proper position. Moreover, the use of crushed, partly damaged, or out-of-round paper rolls with the prior known dispensers has been very difficult.

Certain prior known examination tables have also included separate assemblies for extending and supporting leg rest pads adjacent the end of the articulated top section and for supporting drainage pans beneath the seat sections of such tables. The provision of such separate assemblies not only is expensive and more difficult from the manufacturing standpoint but also consumes considerable space within the table or cabinet which otherwise could be used as storage space.

The present invention overcomes the above problems by providing an articulated patient support cushion including a secure, reliable support means for supporting a pivotable portion thereof at an elevated angle; a simple, convenient paper tray for holding and dispensing paper for covering such a cushion; and an extendible and retractable carriage assembly including an interchangeable leg rest pad and drainage pan which consumes but a minimum of storage space within the table.

SUMMARY OF THE INVENTION

Accordingly, the present invention provides an articulated patient support cushion including an over-center, gravity-type locking apparatus for securely retaining a pivotal section of the cushion in an elevated, inclined position. Preferably, a pivotal locking means is guided for movement by slotted brackets between at least two positions as urged by the force of gravity such that the articulated section is supported either in its raised, elevated position or rests in its normal horizontal position on an underlying surface of the table or cabinet on which it is mounted. Once in its raised, locked position, the articulated section cannot be released until the cushion is further raised and the pivotal locking means apparatus released. Such apparatus prevents accidental release of the section thereby making the table safe and reliable for use in even delicate medical treatments.

In other aspects, the invention provides a one-piece paper tray, preferably molded from plastic including an elongated, depressed trough and an adjacent, elongated aperture through which paper is withdrawn. Rolls of paper to be dispensed to cover the associated patient support cushion are merely laid in the trough when the tray is pivoted downwardly for loading. The trough confines the roll and yet allows it to rotate for withdrawal of paper therefrom. Shouldered areas adjacent the trough are provided such that rolls of different sizes and lengths may be easily accommodated. Moreover, the trough supports uniformly shaped rolls or crushed, deformed rolls equally well without any modification or adjustment.

In a further aspect, the invention provides a carriage assembly at the foot end of the table for supporting a leg rest pad and/or a drainage pad. When retracted beneath the seat section of the articulated patient support cushion, the drainage pan is supported immediately thereunder. When extended, the carriage assembly automatically is raised to a second level such that the leg rest pad will be supported generally flush with the support cushion in its nonelevated position.

The articulated support cushion is preferably a one-piece, seamless cushion which eliminates cracks, holes, or sewn seams which would otherwise collect dirt and the like and make the table unsanitary. The cushion is easily and quickly assembled and disassembled from a supporting framework which is pivotally supported above the upper surface of the examination table or cabinet.

These and other objects, advantages, purposes, and features of the invention will become more apparent from a study of the following description taken in conjunction with the drawings.

DESCRIPTION OF THE PREFERRED EMBODIMENT

Figure 1:
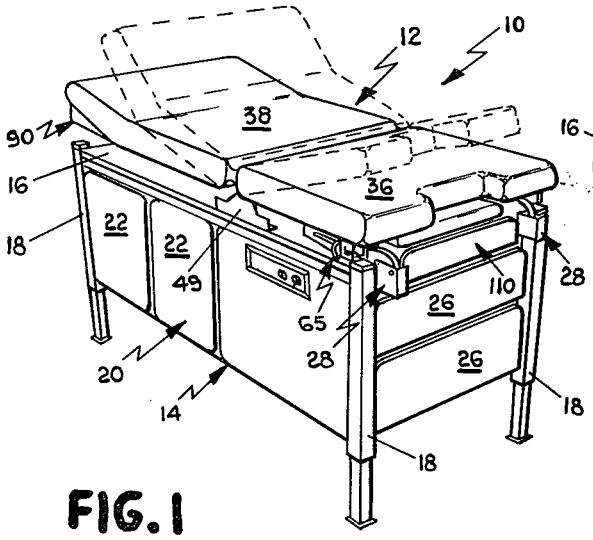
FIG. 1 is a perspective view of an examination table including the articulated patient support cushion of the present invention.

Referring now to the drawings in greater detail, FIG. 1 illustrates the entire examination table assembly 10. Table 10 is of the type disclosed in copendng U.S. patent application Ser. No. 609,171 filed concurrently herewith, invented by Raymond D. Nass and Frank M. Damico, assigned to the same assignee as the present invention, the disclosure of which is hereby incorporated by reference herein. Table 10 includes a one-piece, seamless articulated patient support cushion 12, a generally rectangular cabinet 14 including a top panel or surface 16 on which the support cushion is itself supported, and a plurality of legs 18 one at each external corner of the cabinet 14. Cabinet 14 includes a storage area 20 (FIGS. 1 and 4) accessible from double hinged doors 22, a pair of which are mounted on either side of the storage area and cabinet. Storage area 20 generally extends from the head end of the table approximately two-thirds the length thereof. At the foot end of the table is an area 24 (FIGS. 1 and 4) in which are mounted a pair of vertically aligned, extendible drawers 26 and a pair of spaced, extendible leg stirrups 28 thereabove.

Each of the legs 18 includes a vertically extendible section operated by pulley and cable means 30 which are extended and retracted by a power tramsmission means 32 powered by a power unit 34. The articulated patient support cushion 12 includes generally vertically pivotable seat and head sections 36, 37, respectively. Head section 37 is counterbalanced and supported by a pneumatic cylinder 38 operated by a handle 39 supported by appropriate bracket means beneath the articulated head section. The mechanism for raising and lowering the entire table including telescoping legs legs 18, flexible cable means 30, power transmission means 32 and power unit 34, together with pneumatic cylinder 38, handle and bracket means 39, is more fully described in copending application Ser. No. 609,171 mentioned above.

The particular features of the present invention to be more fully described herein include the support structure 40 for the articulated patient support cushion 12, the over-center, gravity-type, tilt locking apparatus 65, the pivotable molded paper tray 90, and the carriage assembly 110 including the leg rest pad 150 and drainage pad 130.

Figure 2:
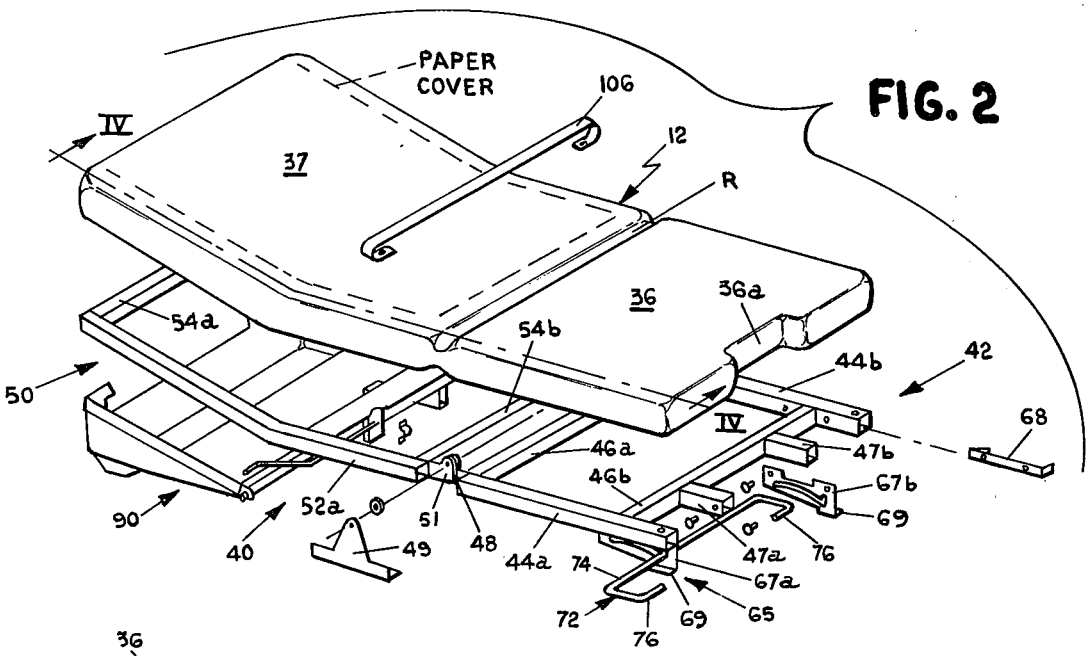
FIG. 2 is an exploded, perspective view of the articulated patient support cushion including the over-center, gravity-type locking means and molded paper tray.
Figure 4:
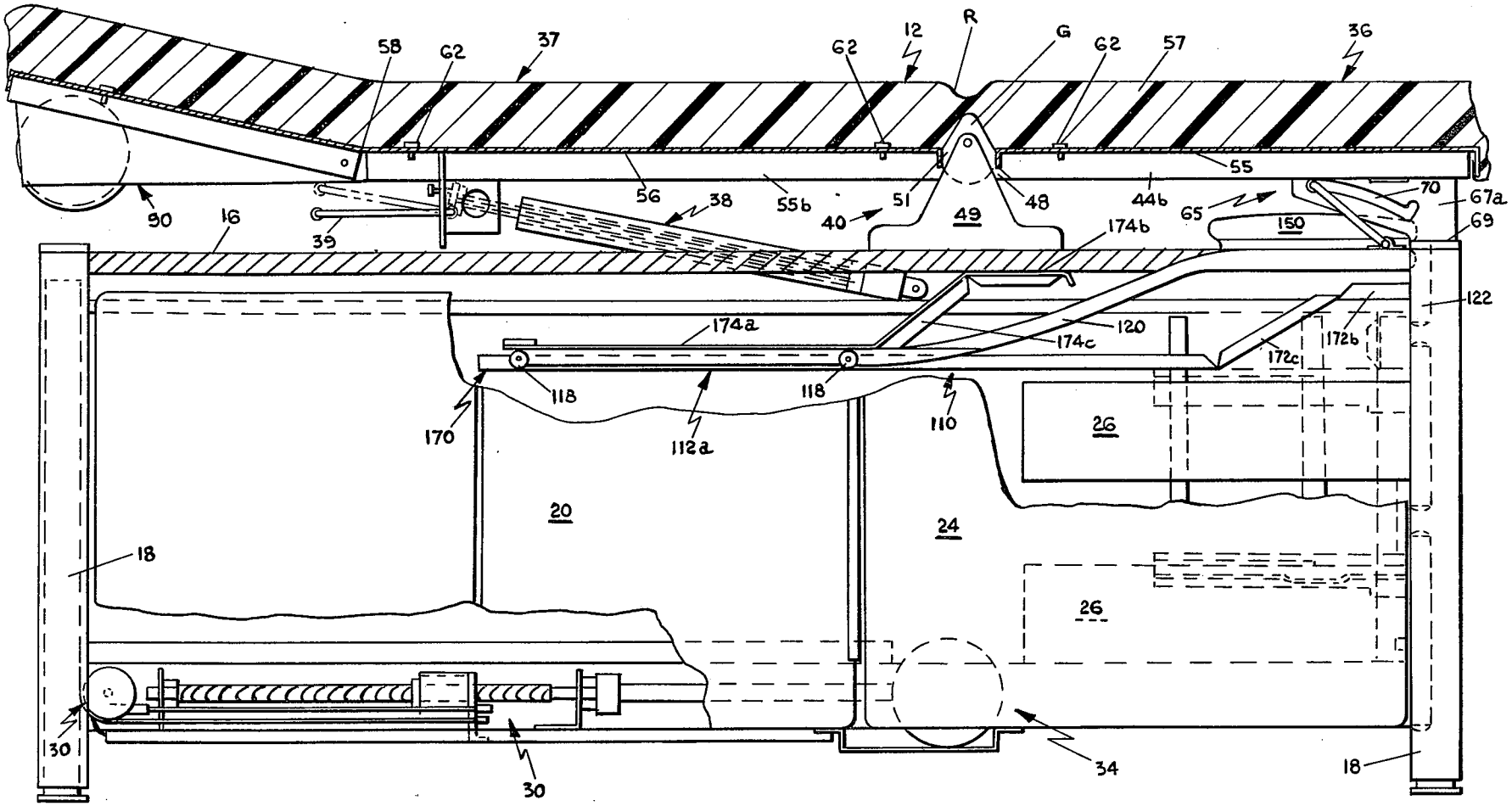
FIG. 4 is a sectional, side elevation of the examination table taken along plane IV—IV of FIG. 2.

Referring now to FIGS. 2 and 4, the support apparatus 40 for the articulated patient support cushion 12 includes a framework formed from rigid tubular members (FIGS. 2 and 4). Framework section 42 for supporting seat section 36 includes a pair of parallel, tubular side rails **44*a*, 44*b* spaced rigidly apart by a pair of spaced, tubular cross members 46*a*, 46*b*. A pair of short, tubular members 47*a*, 47*b* spaced on either side of the perineal cutout 36*a* on seat section 36 extend perpendicularly outwardly from tubular member 46*b*. The seat framework section is pivotally secured to an upstanding, generally triangular-shaped support bracket 49 by a pair of spaced, pivot flanges 48 including apertures aligned along a common axis. A bolt is passed through the upper extremity of bracket 49, pivot flanges 51 which extend rearwardly from the head section 50 of the framework, and on through apertures in the pivot flanges 48. The head framework section 50 is of a similar construction including tubular side rails 52*a*, 52*b* spaced rigidly apart by tubular cross members 54*a*, 54*b*. When bracket 49 is secured by bolts or the like to top panel 16 intermediate the ends of the cabinet, the head and seat framework sections 42, 50** will be pivotally supported above that top panel for movement in generally vertical arcs.

Figure 8:
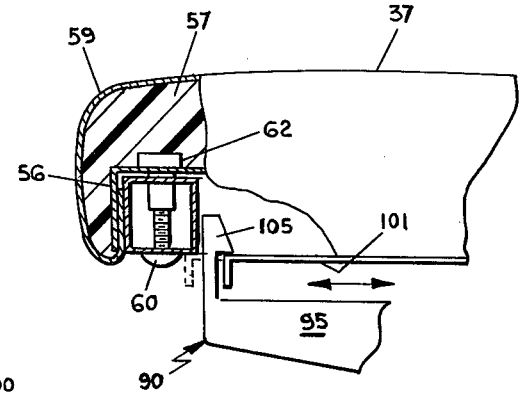
FIG. 8 is a fragmentary, end view of the head section shown in FIGS. 6 and 7 taken partially in section illustrating attachment of the support cushion to its framework and latching of the molded paper tray to the support cushion.

The one-piece seamless, support cushion 12 adapted to fit over support framework 40 is formed from multiple layers of material. As is best seen in FIGS. 4 and 8, cushion 12 includes a pair of preformed bottom pans 55, 56 formed from sheet metal for the seat and head sections, respectively. Head section bottom pan 56 is bent upwardly at 58 to form an inclined head or pillow section on the head section 37 of the cushion. Each pan includes downwardly extending flanges about its periphery. Atop each of the bottom pans and extending across the gap G therebetween at which the entire cushion is pivoted (FIG. 4) is a filler pad 57 formed from a firm grade of flexible, urethane foam. The pad is continuous across the gap G between the pans although the bottom portion is hollowed out therebetween to provide a space for pivotally supporting the cushion between the spaced pair of brackets 49. Over top of the entire cushion is secured a cover sheet 59 (FIG. 8) of thermally formable, vinyl-coated fabric having a minimum thickness of approximately 60 mils. The filler pad extends downwardly over the flanges of the bottom pan while the cover 59 extends completely around both the downwardly extending filler pad and the flanges and is secured with adhesive to the inside surface of the flanges (FIG. 8).

The pivotal support framework 40 is secured within the recess formed by the bottom pans 55, 56 of the patient support cushion 12 by a plurality of threaded fasteners 60 extending upwardly through the tubular frame members into sockets 62 having enlarged heads and extending downwardly at spaced positions through the bottom pans (FIGS. 4 and 8). Accordingly, cushion 12, which is continuous across the gap G between the spaced brackets 49 and is also seamless and includes a waterproof, stain-resistant vinyl cover 59, may be easily inserted and removed on the framework 40 by the plurality of fasteners. When so assembled, the supporting framework 40 is concealed from view by the downwardly extending flanges of the patient support cushion. Moreover, the recess R (FIGS. 2 and 4) above the spaced brackets 49 allows each head section and seat section to be pivoted upwardly in a generally vertical arc without wrinkling the cover.

Referring now to FIGS. 2–5, tilt locking apparatus 65 is provided for supporting vertically pivotable seat section 36 of cushion 12 at an upwardly angled position. The locking apparatus includes a pair of spaced brackets 67*a*, 67*b* each of which is secured by a pair of threaded fasteners inserted through apertures in each bracket into the inside surface of the side rails 44*a*, 44*b*. A filler 68 is inserted within each rail for securing the threaded fasteners. Each bracket 67*a*, 67*b* includes a foot 69 which is positioned to rest atop one of the legs 18 at the foot end of the cabinet when the seat section 36 of cushion 12 is in its normal, horizontal position. Each bracket also includes an arcuate, curved slot 70 curving generally downwardly toward the foot end of the cabinet from end 70*a* toward end 70*b*. At end 70*b*, the slot turns sharply upwardly to provide a rearwardly extending edge 70*c* which retains rod 72 as is described hereinafter.

Cooperating with the pair of spaced brackets 67*a*, 67*b* is a generally U-shaped pivotal rod 72 including a back portion 74 (FIG. 2) extending transversely of the table through the slots 70 in the brackets. Rod 72 also has downwardly extending legs including feet 76 which are aligned along a common axis. Pivotal rod 72 is pivotally secured to the top surface 16 of cabinet 22 generally beneath each bracket 67*a*, 67*b* by clamping brackets 78 secured to the top surface with threaded fasteners or the like. Brackets 67*a*, 67*b* are cut away at an upward angle above the clamping brackets to provide room therefor when the seat section is in its normal horizontal position (FIG. 5).

Figure 5:
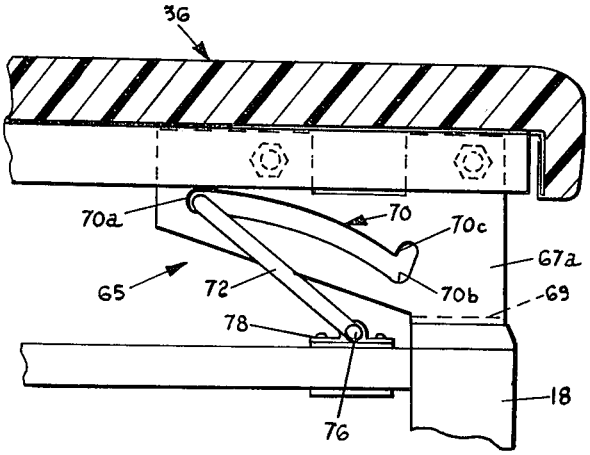
FIG. 5 is a fragmentary, sectional side elevation of the over-center, gravity-type tilt locking apparatus.

As will be seen from FIGS. 1–5, the slots 70 in brackets 67*a*, 67*b* guide the pivotal movement of pivot rod 72 together with the force of gravity such that it moves either toward end 70*a* or end 70*b* and away from its center, vertical position. When pivoted toward the end 70*a*, seat section 36 is in its normal horizontal position (FIGS. 1, 4, and 5). However, when seat section 36 is pivoted upwardly to its inclined, raised position (FIG. 3), support rod 72 is pivoted toward end 70*b* and slides into the sharply upturned slot portion and rests against edge 70*c* (FIG. 5). Application of weight or force to the top of seat section 36 forces rod 72 against edge 70*c* and the end of the upturned slot portion preventing the accidental release and return of seat section 36 to its horizontal position. The only way seat section 36 can be released is by raising section 36 until the back portion 74 of rod 72 is below edge 70*c* and in end 70*b* such that it can be pivoted toward end 70*a* as guided by the slot. Should the support rod 72 be approximately vertically positioned when seat section 36*a* is lowered thereon, the curvature of the slot will force the rod either one way or the other into its locked, raised position or back to its normal, horizontal position.

Figure 6:
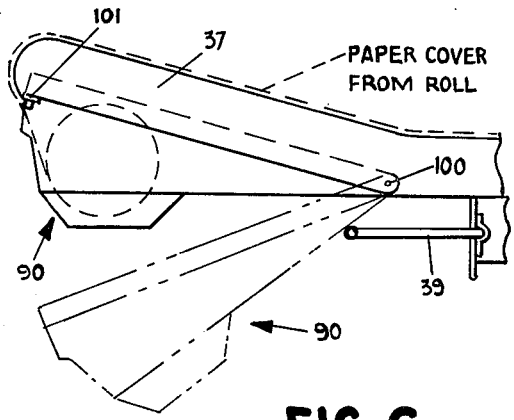
FIG. 6 is a fragmentary, side view of the head end of the articulated head section of the patient support cushion including the molded paper tray pivotally supported thereon.
Figure 9:
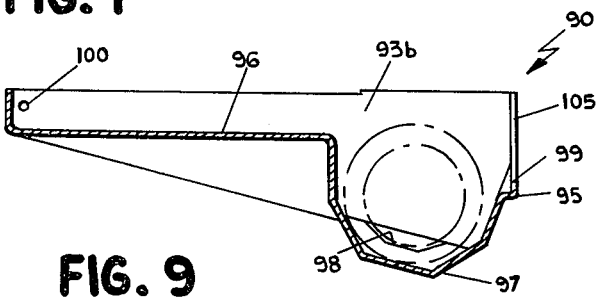
FIG. 9 is a sectional, side elevation of the molded paper tray taken along plane IX—IX of FIG. 7.

Referring now to FIGS. 2 and 6–9, the paper tray for holding and dispensing covering paper for the patient support cushion 12 is shown in greater detail. Tray 90, typically molded in one piece from thermoplastic sheet material such as ABS plastic of approximately 0.125 inch thickness, includes a bottom portion 92, left and right side walls 93*a*, 93*b*, a rear wall 94, and a front wall 95. Each of the side, rear, and front walls extends upwardly. Together they define an open top providing access to the interior of the tray. Each of the side walls 93*a*, 93*b* tapers or widens toward the front wall providing the tray with an overall wedge shape (FIGS. 6 and 9). Such wedge shape matches the angle of inclination of the pillow section of the head section 37 when secured therein (FIG. 6). Bottom wall 92 includes a rear portion 96 extending forwardly generally parallel to the top edge of side walls 93*a*, 93*b*. Bottom wall 92 thereafter drops away into a depressed, recessed trough 97 immediately adjacent, below, and generally parallel to front wall 95. Adjacent either longitudinal end of trough 97 and raised slightly thereabove are a pair of recessed shoulder areas 98. The width of recessed shoulders 98 is generally less than the overall width of trough 97 (FIG. 9). Front wall 95 includes an elongated aperture 99 extending across the complete width of the tray providing a dispensing aperture for release of the paper from the tray.

As shown in FIG. 9, the trough 97 and the pair of aligned shoulder areas 98 is designed to cradle a roll of covering paper therein without the need for axles or roll end-securing devices. The contoured bottom portions of trough 97 cradle the roll and allow it to rotate as paper is withdrawn through aperture 99 in front wall 95 (FIG. 6). Trough 97 generally receives shorter, larger diameter rolls of paper while recessed shoulder areas 98 receive longer, lesser diameter rolls. Because of their cradling effect, both trough 97 and shoulders 98 allow the rolls to rotate without climbing out of the tray whether the rolls are uniformly shaped or are deformed, crushed, or otherwise out of round.

Figure 7:
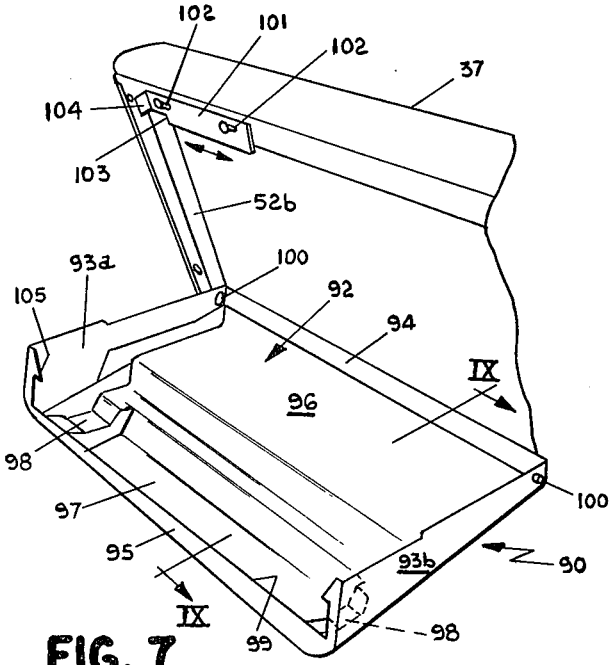
FIG. 7 is a fragmentary, perspective view of the head section shown in FIG. 6 illustrating the molded paper tray pivoted to its open position.

The tray is pivotally secured beneath head section 37 by a pair of aligned pivot studs 100 passed through side walls 93*a*, 93*b* adjacent rear wall 94 into the tubular side rails 52*a*, 52*b* adjacent the line 58 at which the pillow section angles upwardly from the remainder of the head section. As shown in FIGS. 6 and 7, such pivotal attachment allows the tray to be pivoted downwardly for insertion of a fresh roll of covering paper into the trough 97 or depressed shoulders 98. Typically, the head section 37 is raised when the tray 90 is pivoted downwardly for insertion of a roll. When pivoted downwardly, the tray rests on and is supported by the ends of handle 39 (FIG. 6).

In order to hold the paper tray upwardly against the underside of the head section 37, a pair of sliding latch plates 101 are provided at the extreme end of head section 37 one adjacent either lateral side thereof. Latch plates 101 are slidably secured by rivets or the like to cross member 54*a* by elongated slots 102. Each latch plate includes an edge 103 adapted to be slid under a molded, inturned hook or flange portion 105 formed on either lateral edge of front wall 95 of tray 90 (FIGS. 7 and 8). After insertion of the roll and withdrawal of a short portion of the paper through aperture 99, the tray is pivoted upwardly against the underside of cushion 37 after which sliding latch plates 101 are slid laterally outwardly by handles 104 to engage edges 103 beneath hook or flange portions 105. A paper cutting strap 106 having end snaps for securing it to the underside of head section 37 is fastened near and generally parallel to recess R for severing used paper from the roll.

Figure 3:
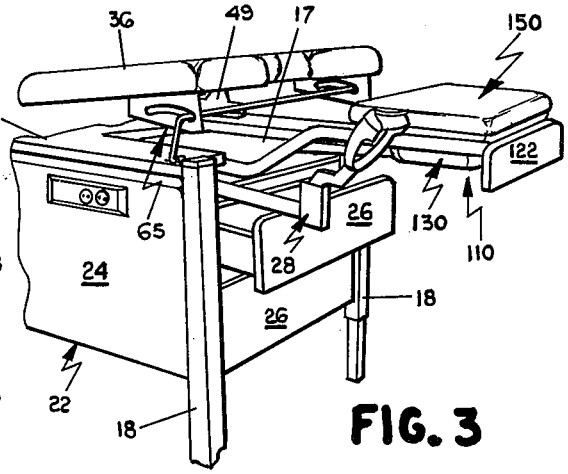
FIG. 3 is a fragmentary, perspective view of the foot end of the examination table of FIG. 1 illustrating the locking means supporting the articulated seat section in a raised position and the carriage assembly including the leg rest pad and drainage pan pulled to its extended position.
Figure 11:
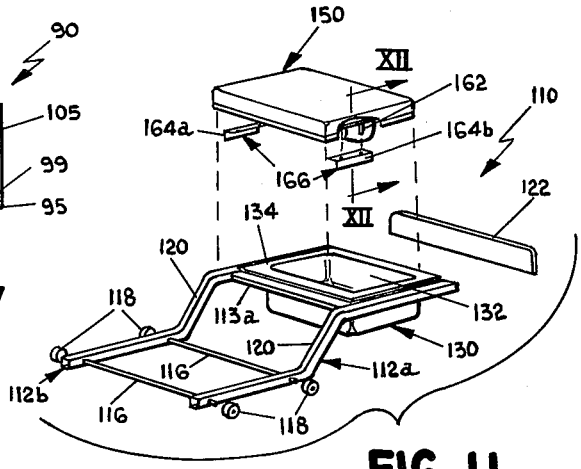
FIG. 11 is a perspective, partially exploded view of the carriage assembly illustrating the leg rest pad and drainage pan with portions of the leg rest pad broken away to reveal the locating means thereon.
Figure 10:
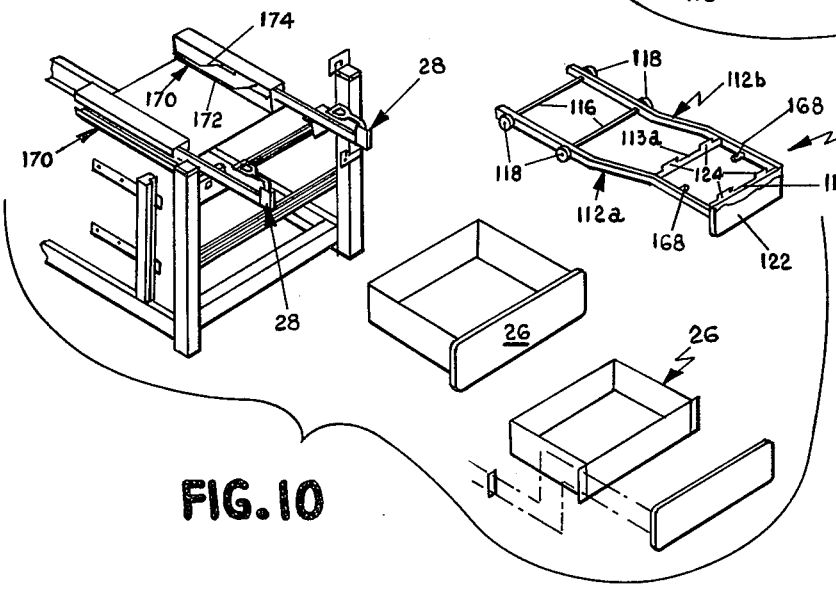
FIG. 10 is a fragmentary, perspective, exploded view of the foot end of the examination table including the framework for the carriage assembly.
Figure 12:
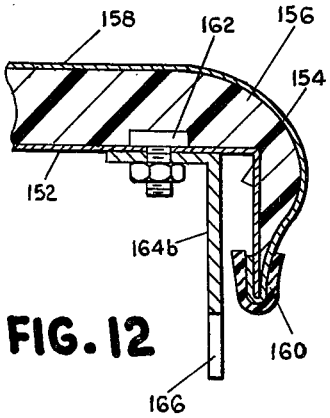
FIG. 12 is a fragmentary, sectional view of the leg rest pad taken along plane XII—XII of FIG. 11.

As shown in FIGS. 3, 4 and 10–12, carriage assembly 110 is adapted to be extended and withdrawn through a rectangular opening 17 formed in the foot end of top surface 16 of cabinet 22 (FIG. 3). Carriage assembly 110 includes a pair of parallel, rigid tubular members 112*a*, 112*b* spaced rigidly apart by a pair of rigid cross members 113*a*, 113*b*, at one end of the side rails, and a pair of axle rods 116 at the opposite end. Axles 116 extend through the tubular members and receive wheels 118 on the ends thereof for movable support of the assembly. The end of the rails 112*a*, 112*b* including axles 116 is vertically offset from the end including cross members 113*a*, 113*b* by inclined sections 120 of the tubular members (FIGS. 10 and 11). Thus, the portion including wheels 118 can be mounted within the cabinet while the other end of the rail supports interchangeable leg rest pad 150 and/or drainage pan 130 at a higher level as shown in FIGS. 3 and 4. A covering panel 122 is secured across the exposed ends of the rails 112*a*, 112*b* at the foot end of the cabinet.

Each of the cross members 113*a*, 113*b* includes a pair of spaced, raised flanges 124 for supporting drainage pan 130 therebetween. Drainage pan 130 is typically a stamped stainless steel pan including a depressed rectangular central area and an upper, outer peripheral flange 134 extending around the depressed central area. The spacing between cross members 113*a*, 113*b* is predetermined such that the depressed central area 132 may be received therebetween while the raised flanges 124 on the cross members engage and support the peripheral flange 134 of the pan.

A removable leg rest pad 150 may be placed on the carriage assembly 110 even while drainage pan 130 remains supported thereon. Leg rest pad 150 includes a stamped or otherwise preformed metallic bottom pan 152 (FIG. 12) including downwardly extending flanges 154. A filler pad of foamed material, similar to that used in the patient support cushion 12, is laid over the exterior of the bottom pan and extends downwardly over the downwardly extending side flanges 154. A thermo-formable, vinyl-coated fabric cover 158 similar to that used in the cushion 12 is placed over filler pad 156. Cover 158 extends downwardly over and around flange 154 and is secured to the interior side thereof. An extruded vinyl edge 160 is placed over the wrapped cover 158 and flange 154 around the entire lower edge to finish the same.

Secured within the recess formed by the bottom pan 152 adjacent either lateral side flange of the pad 150 are a pair of generally L-shaped angle brackets 164*a*, 164*b*. These brackets are secured by threaded fasteners 162 extending downwardly through the bottom pan and one flange of the bracket. The remaining flange of each bracket 164*a*, 164*b* includes a centrally located, downwardly opening recess 166 (FIGS. 11 and 12) adapted to fit over and engage one of a pair of aligned projecting studs 168 extending inwardly from the inside surface of each of the tubular side rails 112*a*, 112*b* of carriage assembly 110. Studs 168 are centrally located between cross members 113*a*, 113*b* and provide a locating means for positioning the leg rest pad 150 atop side rails 112*a*, 112*b* and cross members 113*a*, 113*b*. Studs 168 are threaded such that nuts may be applied to permanently secure the pad 150 on the carriage assembly if desired.

Support for the carriage assembly 110 is provided by a pair of spaced support brackets 170 aligned with one another and secured generally centrally within the interior of cabinet 22 of table 10 (FIGS. 4 and 10). Each bracket 170 includes a lower track member 172 including a first portion 172*a* at a lower level, a second horizontal portion 172*b* at a higher, raised horizontal level adjacent the end of the cabinet, and an intermediate, inclined portion 172*c* connecting portions 172*a*, 172*b*. Likewise, each bracket includes an upper track member 174 including a first horizontal portion 174*a* spaced slightly above portion 172*a* of track member 172 and a second horizontal portion 172*b* at a higher horizontal level. An inclined section 174*c* interconnects portions 174*a*, 174*b*. Track members 172, 174 and especially inclined sections 172*c*, 174*c* are spaced apart by the same distance that axles 116 are spaced apart such that wheels or bearings 118 will engage the inclined portions simultaneously.

As is best understood from FIG. 4, extension of carriage assembly 110 on wheels 118 causes either the supported drainage pan 130 and/or leg rest pad 150 to move outwardly at a first level immediately below the patient support cushion 12 (FIG. 4) until the wheels engage the inclined portions 172*c*, 174*c*. Further extension of the carriage assembly causes it to be raised along inclined portions 172*c*, 174*c* with the upper surface of track portion 174 preventing the downward tipping of the cantilevered supported pan and/or leg rest by engagement with the rearwardmost wheels 118. At the top of the inclined portions, further extension of the carriage assembly causes the forwardmost wheels 118 to be supported therebeneath by track portions 172*b* and rearwardmost wheels 118 to be supported thereabove by track portions 174*b*. At this point, the drainage pan and/or leg rest pad is supported generally flush with the level of the seat section 36 of cushion 12 in its down or horizontal position (FIG. 3). Retraction of the carriage assembly causes inward and downward movement in the reverse of the above manner through aperture 17 in top surface 16. At the inwardmost position (FIG. 4), the drainage pan is supported generally below the perineal cutout 36*a* while the remainder of the carriage assembly is concealed from view.

As seen in FIGS. 10 and 11, studs 168 do not extend outwardly far enough to prevent the insertion of the depressed portion 132 of pan 130. Moreover, the lateral side flanges on pan 130 do not extend completely to the inside surfaces of rails 112*a*, 112*b*. Hence, the downwardly extending flanges of brackets 164*a*, 164*b* on leg rest 150 can be inserted over studs 168 even while the pan remains supported by the carriage assembly. The leg rest must be removed for use of the drainage pan.

While one form of the invention has been shown and described, other forms will now be apparent to those skilled in the art. Therefore, it will be understood that the embodiment shown in the drawings and described above is merely for illustrative purposes and is not intended to limit the scope of the invention which is defined by the claims which follow.

The embodiments of the invention in which an exclusive property or privilege is claimed are defined as follows.

1. An articulated patient support cushion for an examination table, said cushion having a head support section and a seat support section, at least one of said sections being pivotable with respect to the other; means for supporting said sections on an examination table or the like having a surface underlying said cushion including means for pivotally supporting said pivotable section for movement in a generally vertical arc between at least a first generally horizontal position and a second position in which it is inclined upwardly at an angle to the first position; tilt means for holding said pivotable section in said positions, said tilt means including a pivoted, rigid, locking means, said locking means being pivotal by gravity on each side of a vertically extended center line, said locking means, when pivoted to one side of said center line, securely retaining said pivotal section in said second position; and a one-piece tray mounted beneath one of said head and seat support sections and having closed bottom and side walls and an open top adapted to abut the under surface of said one section, said tray adapted to hold therewithin and dispense therefrom paper from a roll for covering portions of said support cushion.

2. The patient support cushion of claim 1 wherein said tray includes paper roll receiving means for supporting a roll of paper within said tray, an aperture for removing paper from a roll in said receiving means, and means for pivotally supporting said tray under said cushion for movement between a first position in which said open top abuts said underface of said one section and a second position in which said open top is exposed for insertion of a roll of paper, said roll being substantially concealed from view within said tray when said tray is in its first position.

3. The patient support cushion of claim 2 wherein said paper roll receiving means include at least one elongated depressed trough for engaging the external circumferential surface of and cradling a roll of paper therein, said trough allowing a roll of paper which is either substantially cylindrical or partially crushed, deformed or otherwise out of round to rotate within said trough to allow a strip of paper to be dispensed through said aperture.

4. The patient support cushion of claim 3 wherein said paper roll receiving means include a pair of aligned shoulder-like depressions, one adjacent each end of said trough for receiving and engaging the external circumferential surface of a roll of paper of different roll-end to roll-end length than that received in said trough.

5. The patient support cushion of claim 3 wherein said cushion section on which said tray is mounted is pivotal upwardly; said means for pivotally supporting said tray include a pair of spaced pivot studs engaging the underside of said pivotable cushion section, said tray adapted to be pivoted downwardly to said second position for insertion of a roll of paper when said pivotable cushion section is pivoted upwardly; and releasable latch means for holding said tray in said first position against the underside of said pivotable cushion section after insertion of said roll of paper.

6. The patient support cushion of claim 1 wherein one end of said head section is inclined upwardly at an angle to the remainder of said head section, said tray having an overall wedge shape including a surface inclined at an angle matching that of said end of said head section; means for pivotally securing said tray to the underside of said inclined end of said head section.

7. The patient support cushion of claim 1 wherein said tray includes paper roll receiving means for supporting the external surface of a roll of paper within said tray and allowing rotation of said roll as paper is withdrawn therefrom.

8. A one-piece, contoured tray for holding and dispensing paper from a roll for covering portions of an examination table cushion, said tray comprising a bottom, and upwardly extending side and end walls defining an open top; said bottom including paper roll receiving means for receiving and supporting a roll of paper; an aperture in one of said walls adjacent said paper roll receiving means; and securing means for securing said tray to a patient support cushion or the like whereby said roll can rotate in said receiving means as paper from said roll is withdrawn through said aperture; an articulated patient support cushion for an examination table, said cushion having a head support section and a seat support section, at least one of said sections being pivotable with respect to the other; means for supporting said sections on an examination table or the like having a surface underlying said cushion including means for pivotally supporting said pivotable section for movement in a generally vertical arc between at least a first generally horizontal position and a second position in which it is inclined upwardly at an angle to the first position; said tray being secured beneath said pivotal section of said cushion.

* * * * *

UNITED STATES PATENT AND TRADEMARK OFFICE

CERTIFICATE OF CORRECTION

PATENT NO. : 4,034,972

DATED : July 12, 1977

INVENTOR(S) : Warren J. Peterson

It is certified that error appears in the above-identified patent and that said Letters Patent are hereby corrected as shown below:

Column 2, Line 36;

"drainage pad" should be --drainage pan--

Column 6, Line 10;

"edge" should be --edges--

Column 9, Line 20;

"underface" should be --undersurface--

Signed and Sealed this

*Seventh* Day of *February 1978*

[SEAL]

*Attest:*

RUTH C. MASON
*Attesting Officer*

LUTRELLE F. PARKER
*Acting Commissioner of Patents and Trademarks*